US009630635B2

(12) United States Patent
Toshack

(10) Patent No.: US 9,630,635 B2
(45) Date of Patent: Apr. 25, 2017

(54) TRAIN DIRECTION AND ROUTE DETECTION VIA WIRELESS SENSORS

(71) Applicant: Siemens Canada Limited, Burlington, Ontario (CA)

(72) Inventor: Frederick Toshack, London (CA)

(73) Assignee: SIEMENS CANADA LIMITED, Ontario (CA)

( * ) Notice: Subject to any disclaimer, the term of this patent is extended or adjusted under 35 U.S.C. 154(b) by 42 days.

(21) Appl. No.: 14/636,452

(22) Filed: Mar. 3, 2015

(65) Prior Publication Data

US 2016/0257322 A1 Sep. 8, 2016

(51) Int. Cl.

| | |
|---|---|
| ***B61L 25/00*** | (2006.01) |
| ***B61L 25/02*** | (2006.01) |
| ***B61L 13/00*** | (2006.01) |
| ***B61L 27/00*** | (2006.01) |
| ***B61L 29/18*** | (2006.01) |
| ***B61L 29/22*** | (2006.01) |
| ***B61L 29/28*** | (2006.01) |
| ***B61L 29/32*** | (2006.01) |

(52) U.S. Cl.

CPC ..... *B61L 25/023* (2013.01); *B61L 13/002* (2013.01); *B61L 27/0077* (2013.01); *B61L 29/18* (2013.01); *B61L 29/22* (2013.01); *B61L 29/282* (2013.01); *B61L 29/32* (2013.01); *B61L 2205/00* (2013.01)

(58) Field of Classification Search

CPC .... B61L 25/023; B61L 25/025; B61L 25/026; B61L 25/028; B61L 13/002; B61L 27/0077; B61L 29/18

See application file for complete search history.

(56) References Cited

U.S. PATENT DOCUMENTS

| | | | | |
|---|---|---|---|---|
| 5,170,970 | A * | 12/1992 | Ballinger | B61L 29/286 246/126 |
| 5,699,986 | A * | 12/1997 | Welk | B61L 29/24 246/122 R |
| 5,868,360 | A * | 2/1999 | Bader | B61L 29/284 246/202 |
| 6,292,112 | B1 * | 9/2001 | Bader | G08G 1/042 246/202 |
| 6,604,031 | B2 * | 8/2003 | Oguma | B61L 23/168 246/28 R |
| 7,975,968 | B2 * | 7/2011 | Bohlmann | B61L 1/181 246/122 R |
| 8,297,558 | B2 * | 10/2012 | O'Dell | B61L 29/226 246/126 |
| 8,500,071 | B2 * | 8/2013 | O'Dell | B61L 29/28 246/111 |
| 8,515,697 | B2 * | 8/2013 | Alexander | B61L 1/20 246/122 R |
| 2004/0181321 | A1 * | 9/2004 | Fries | B61L 29/226 701/19 |
| 2005/0253926 | A1 * | 11/2005 | Chung | B61L 15/0027 348/148 |
| 2008/0169385 | A1 * | 7/2008 | Ashraf | B61L 29/28 246/130 |

(Continued)

*Primary Examiner* — Jason C Smith

(57) ABSTRACT

Systems and methods for detecting train direction and route along a railroad track. The systems and methods use wireless train presence detection sensors such as e.g., magnetometer sensors to detect the presence of the train, and its direction and route along the track.

14 Claims, 4 Drawing Sheets

(56) References Cited

U.S. PATENT DOCUMENTS

| | | | | |
|---|---|---|---|---|
| 2010/0108823 | A1* | 5/2010 | Barnes | E01F 13/06 246/111 |
| 2011/0011985 | A1* | 1/2011 | Hogan | B61L 1/188 246/34 R |
| 2011/0130899 | A1* | 6/2011 | Beaurent | B61L 25/023 701/19 |
| 2011/0174934 | A1* | 7/2011 | Kikuchi | B61L 1/187 246/122 R |
| 2013/0062474 | A1* | 3/2013 | Baldwin | B61L 29/282 246/122 R |
| 2013/0248658 | A1* | 9/2013 | Takagi | B61L 25/025 246/122 R |
| 2013/0299645 | A1* | 11/2013 | Cooper | H04L 67/14 246/122 R |
| 2014/0319286 | A1* | 10/2014 | Hogan | B61L 29/226 246/122 R |
| 2014/0326835 | A1* | 11/2014 | Schwellnus | B61L 25/02 246/122 R |
| 2015/0134155 | A1* | 5/2015 | Kanner | G01B 7/125 701/19 |
| 2016/0001803 | A1* | 1/2016 | Kim | G01S 13/06 246/124 |

* cited by examiner

TRAIN DIRECTION AND ROUTE DETECTION VIA WIRELESS SENSORS

FIELD

Embodiments disclosed herein relate to railroad train direction and route detection and, more particularly, to train direction and route detection using wireless presence detection sensors such as e.g., magnetometer sensors.

BACKGROUND

A constant warning time device (often referred to as a crossing predictor or a grade crossing predictor in the U.S., or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by moving objects). The constant warning time device will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are often (but not always) configured to activate the crossing warning device at a fixed time (e.g., 30 seconds) prior to an approaching train arriving at a crossing.

Typical constant warning time devices include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of constant warning time devices generate and transmit a constant current AC signal on said track circuit; constant warning time devices detect a train and determine its distance and speed by measuring impedance changes caused by the train's wheels and axles acting as a shunt across the rails, which effectively shortens the length (and hence lowers the impedance) of the rails in the circuit. Multiple constant warning devices can monitor a given track circuit if each device measures track impedance at a different frequency.

Federal regulations mandate that a constant warning time device be capable of detecting the presence of a train as it approaches a crossing and to activate the crossing warning devices in a timely manner that is suitable for the train speed and its distance from the crossing. In addition, the device must be capable of detecting trains that approach the crossing from both directions of the crossing (e.g., from east to west and from west to east, north to south and south to north, etc.) and from every possible route (i.e., the physical path) through the crossing.

Legacy crossing warning systems are set up to only provide the warnings to oncoming automobile and pedestrian traffic and have very little recording or reporting capability. In the U.S., the Federal Railroad Administration (FRA) mandates annual testing, requiring the railroad's staff to physically run or simulate train movement from all directions and routes. The results of this testing must be submitted to the FRA. This is a heavy burden and expense to the railroads because e.g., it is time consuming and can require running additional locomotive engines to prove the routes and warning times. The burden and expense is exacerbated for more complicated crossing warning systems having switches and multiple routes.

Thus, there is a need and desire for a fast and reliable technique for determining the direction and route of a train traveling along a railroad track so that the information can be used to satisfy regulations such as e.g., the crossing warning time regulations of the FRA.

DETAILED DESCRIPTION

Embodiments disclosed herein provide systems and methods for detecting train direction and route along a railroad track. The systems and methods use wireless presence detection sensors such as e.g., magnetometer sensors to detect the presence of the train, and its direction and route along the track. The systems and methods disclosed herein can report the train direction and route detection information in an automated manner, which could be used along with other automatically collected data to satisfy FRA regulations and other regulations.

Figure 1:
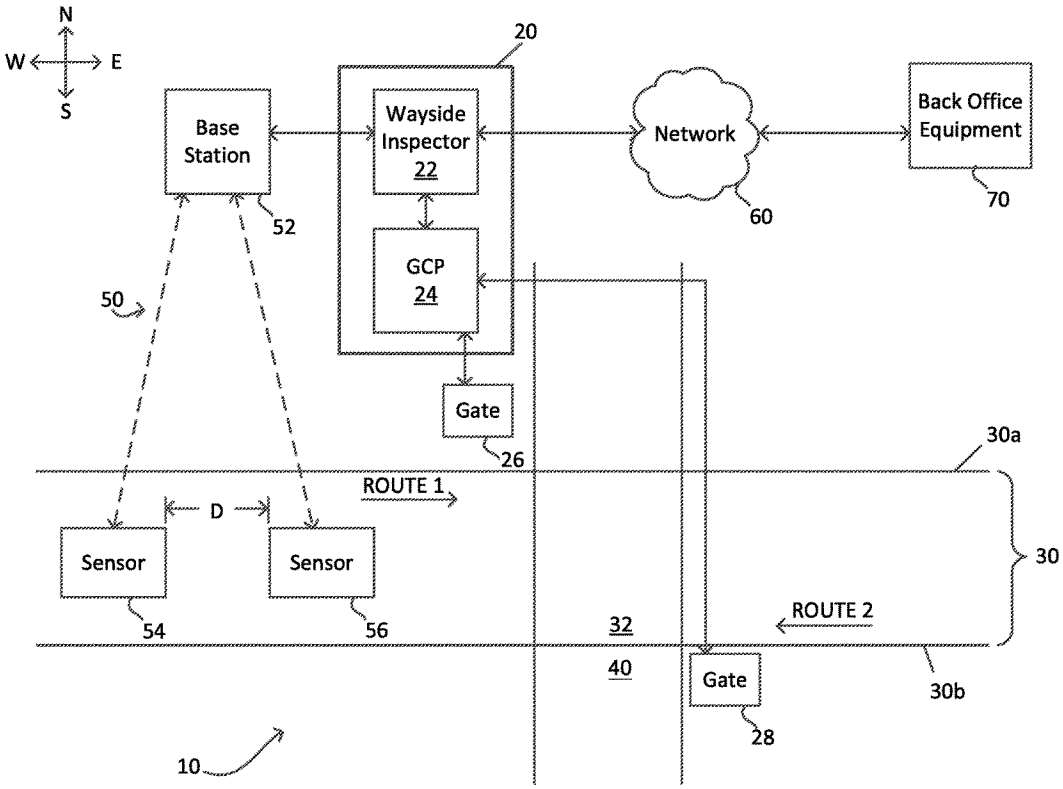
FIG. 1 illustrates a diagram of an example train direction and route detection system in accordance with an embodiment disclosed herein.

FIG. 1 illustrates an example railroad system 10 constructed in accordance with a disclosed embodiment. The system 10 is illustrated as being associated with a particular portion of a railroad track 30, specifically at a point where the track 30 crosses a segment of a road 40 (also referred to herein as a crossing). An island 32 is formed at the point where the track 30 crosses the road 40. The illustrated track 30 comprises two rails 30*a*, 30*b* and a plurality of ties (not shown in FIG. 1) that are provided over and within railroad ballast (not shown) to support the rails. The illustrated rails 30*a*, 30*b* are laid out in an east-to-west/west-to-east direction. In the illustrated embodiment, there are two routes ROUTE 1, ROUTE 2 for a train to pass through the crossing. It should be appreciated, however, that the track 30 could be laid out in other directions. It should also be appreciated that the track 30 could comprise more than two rails 30*a*, 30*b* and one or more switches (for moving the rails into different position), forming different routes through the crossing.

The illustrated system 10 includes two crossing gates 26, 28 located at opposite sides of the road 40. The gates 26, 28 serve as crossing warning devices for the crossing. The gates 26, 28 are controlled by a gate crossing predictor (GCP) and gate control mechanism collectively illustrated as GCP 24 in FIG. 1. The GCP 24 is contained within a housing 20 such as e.g., a wayside equipment shed or bungalow typically located alongside the track 30. As known in the art, and as discussed above, the gate crossing predictor within GCP 24 has at least one transmitter and at least one receiver connected to the rails 30*a*, 30*b* (connections not shown). As is also known, the predictor serves as a constant warning time device that determines an approaching train's speed and distance and produces constant warning time signals that are used by a gate control circuit within GCP 24 to lower the gates 26, 28. As is known in the art, FRA regulations mandate that the gates 26, 28 be lowered no later than a pre-determined period of time (set by regulations) before the train reaches the crossing. As noted above, the FRA requires testing to ensure that the regulations are being adhered to.

The railroad system 10 also includes a wayside inspection system 50 constructed in accordance with an embodiment disclosed herein. As is discussed in more detail below, the wayside inspection system 50 has the ability to detect and report: the presence of a train traveling along the track 30, the direction the train is traveling, and the route the train is taking through the crossing. The illustrated wayside inspection system 50 includes two presence detection sensors 54, 56 located between the rails 30*a*, 30*b* e.g., within separate railroad ties (not shown) or the ballast (not shown) at one side of the crossing. The sensors 54, 56 are spaced apart from each other by a predetermined distance D. The distance D can be any distance suitable to allow each sensor 54, 56 the time to separately detect the presence of the train and then report the detection to a base station 52 (explained in more detail below) in the same order that the detections occurred.

As explained below in more detail with respect to FIG. 2, train direction and route detection will be determined based on the order of the detections made by the sensors 54, 56. For example, if sensor 54 detects the train first and sensor 56 detects the train second, then in the illustrated embodiment, the train is traveling east (i.e., from the west to the east) and is taking ROUTE 1 through the crossing. Likewise, if sensor 56 detects the train first and sensor 54 detects the train second, then in the illustrated embodiment, the train is traveling west (i.e., from the east to the west) and is taking ROUTE 2 through the crossing. Because one sensor may be closer to the base station 52 than the other sensor, the sensors need to be spaced apart just enough to ensure that the reported detections are received by the base station 52 in the order they were made. In one embodiment, the distance D is at least fifty feet.

FIG. 1 illustrates a track 30 having only two rails 30*a*, 30*b* and two routes ROUTE1, ROUTE 2; therefore, only one pair of sensors 54, 56 are needed to detect trains traveling through the crossing (i.e., regardless of the route or direction of the train, the train will pass over the sensors 54, 56). It should be appreciated, however, that if there are more rails and/or possible routes at the crossing, then more presence detection sensors 54, 56 would be required to ensure that the presence of approaching trains are detected for every possible train route and direction at a crossing.

In the illustrated embodiment, the sensors 54, 56 wirelessly communicate with a base station 52 configured to communicate with the sensors 54, 56. The base station 52 is connected to a wayside inspector 22 that is desirably located within the same housing 20 as the GCP 24. Due to the proximity of the base station 52 to the wayside inspector 22, the connection between the base station 52 and the wayside inspector 22 can be a wired or wireless connection. Details of an example wayside inspector 22 are discussed below with respect to FIG. 4.

The illustrated railroad system 10 also includes back office equipment 70 (e.g., a computer system) that communicates with the wayside inspector 22 via a network connection 60 such as e.g., the Internet. In operation, the railroad system 10 will implement the train direction and route detection method 200 illustrated in FIG. 2 (discussed below in more detail).

In a desired embodiment, the presence detection sensors 54, 56 are wireless magnetometer sensors that detect the presence of a train via a change in magnetic field. The sensors 54, 56 are wireless in the sense that they are not connected to the base station 52, track 30, power source or other component by cabling or wires. One suitable wireless magnetometer sensor is the Wimag VD sensor manufactured by Siemens. The Wimag VD sensor is a battery powered sensor having a ten year battery life. Thus, power or cabling are not required to be installed at the site, reducing the costs of parts and labor to implement the system 10. The Wimag VD sensor can be embedded within the ground, ballast, railroad ties, road, etc. and still wirelessly communicate via e.g., a radio link with the appropriate Wimag base station (also manufactured by Siemens). Thus, there is little chance of damage to the sensors caused by e.g., trains or adverse weather conditions during the lifetime of the sensors. As such, once set up, the wayside inspection system 50 can remain essentially maintenance free for at least ten years using the Wimag equipment. Moreover, because the sensors 54, 56 will be placed between the rails 30*a*, 30*b* trains travel over, there is little chance that the sensors 54, 56 will fail to detect the presence of a train.

As can be appreciated, if Wimag VD sensors are used for the sensors 54, 56, then a Wimag base station should be used for the illustrated base station 52. The Wimag sensors and base station are configured to communicate with each other wirelessly. Thus, wireless data communications occur between the sensors 54, 56 and the base station 52, meaning that no cables or wires are required between the sensors 54, 56 and the base station 52. Currently, the Wimag base station has an Ethernet port for communicating with another device (e.g., the wayside inspector 22 in the illustrated embodiment) via an Ethernet connection. It should be appreciated, however, that alternative communication methods (e.g., wireless communications) between the base station 52 and wayside inspector 22 could be used if the base station 52 has other communication mechanisms installed therein or connected to it.

Figure 2:
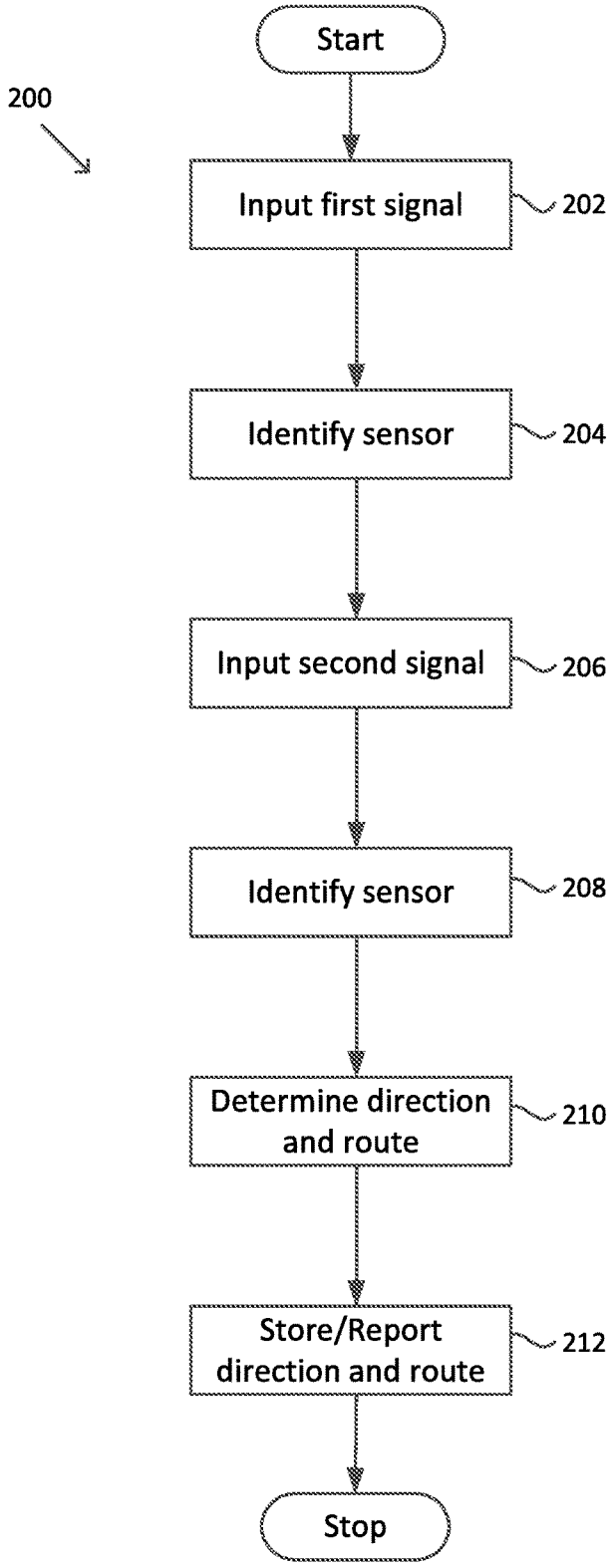
FIG. 2 illustrates a flowchart of an example train direction and route detection method in accordance with an embodiment disclosed herein.

FIG. 2 illustrates a train direction and route detection method 200 in accordance with the disclosed principles. In one embodiment, the method 200 would continually run as a task performed by the wayside inspector. In another embodiment, portions of the method 200 (explained below) could be run as a task performed by the wayside inspector and other portions of the method 200 would be run by the back office equipment 70.

The method 200 begins when a first train detection signal is input at the wayside inspector 22 at step 202. In operation, when one of the sensors 54, 56 detects the presence of a train, a train detection signal along with information identifying the sensor that detected the train is wirelessly transmitted from that sensor to the base station 52. The base station 52 creates a time stamp for the received information. It should be appreciated that the train detection signal and sensor identifying information can be part of the same data message or different data messages transmitted from the sensor 54, 56 to the base station 52. Only one time stamp, however, is required even if the information is received via different messages. The base station 52 transmits the information it receives (i.e., train detection signal and sensor identifier) and the time stamp to the wayside inspector 22 in any suitable manner (e.g., data message). The wayside inspector 22 inputs the train detection signal (step 202) and then identifies the detecting sensor via the sensor identifier that was also received from the base station (step 204).

The method continues at step 206 when the wayside inspector 22 inputs a second train detection signal from the base station 52. The wayside inspector 22 identifies the detecting sensor via the sensor identifier that was also received from the base station (step 208). At this point, the wayside inspector 22 can use the detected signals, sensor identifiers and corresponding time stamps to determine the train's direction and route at step 210. For example, the wayside inspector component 22 will have a database, look-up table, data structure or other suitable mechanism that contains the train direction and route based on the order of the received train detection signals (from steps 202 and 206) and the sensor identifiers (from steps 204 and 208). For the example system illustrated in FIG. 1, the wayside inspector component 22 will have a database, look-up table, data structure, etc. that associates the direction east (or west to east) and route ROUTE 1 to the scenario when sensor 54 is the first detecting sensor and sensor 56 is the second detecting sensor. Likewise, the database, look-up table, data structure, etc. will associate the direction west (or east to west) and ROUTE 2 to the scenario when sensor 56 is the first detecting sensor and sensor 54 is the second detecting sensor.

In one embodiment, the wayside inspector 22 includes a database, look-up table, data structure, etc. containing the direction and route for every combination of sensors, directions and routes for the crossing. The detected train direction and route can be stored by the wayside inspector 22 and then transmitted to the back office equipment (step 212). The wayside inspector 22 can also input the corresponding crossing warning time associated with the detected train from the GCP 24. This way, the crossing warning time and the train's direction and route will be reported to the back office equipment 70 where the information can be stored and then reported to the FRA. In another embodiment, the wayside inspector 22 can report determined train direction, route and/or corresponding crossing warning time information directly to e.g., a regulating body or train personnel.

In addition to or alternatively, the back office equipment 70 can includes a database, look-up table, data structure, etc. containing the direction and route for every combination of sensors, directions and routes for every crossing that is part of the system 10. The back office equipment 70 can also receive the corresponding crossing warning time associated with the detected train. This way, the crossing warning time and the train's direction and route will be determined, stored and then reported to e.g., a regulating body or train personnel by the back office equipment 70, which would simplify the operations performed by each wayside inspector 22 within the system 10.

Figure 3:
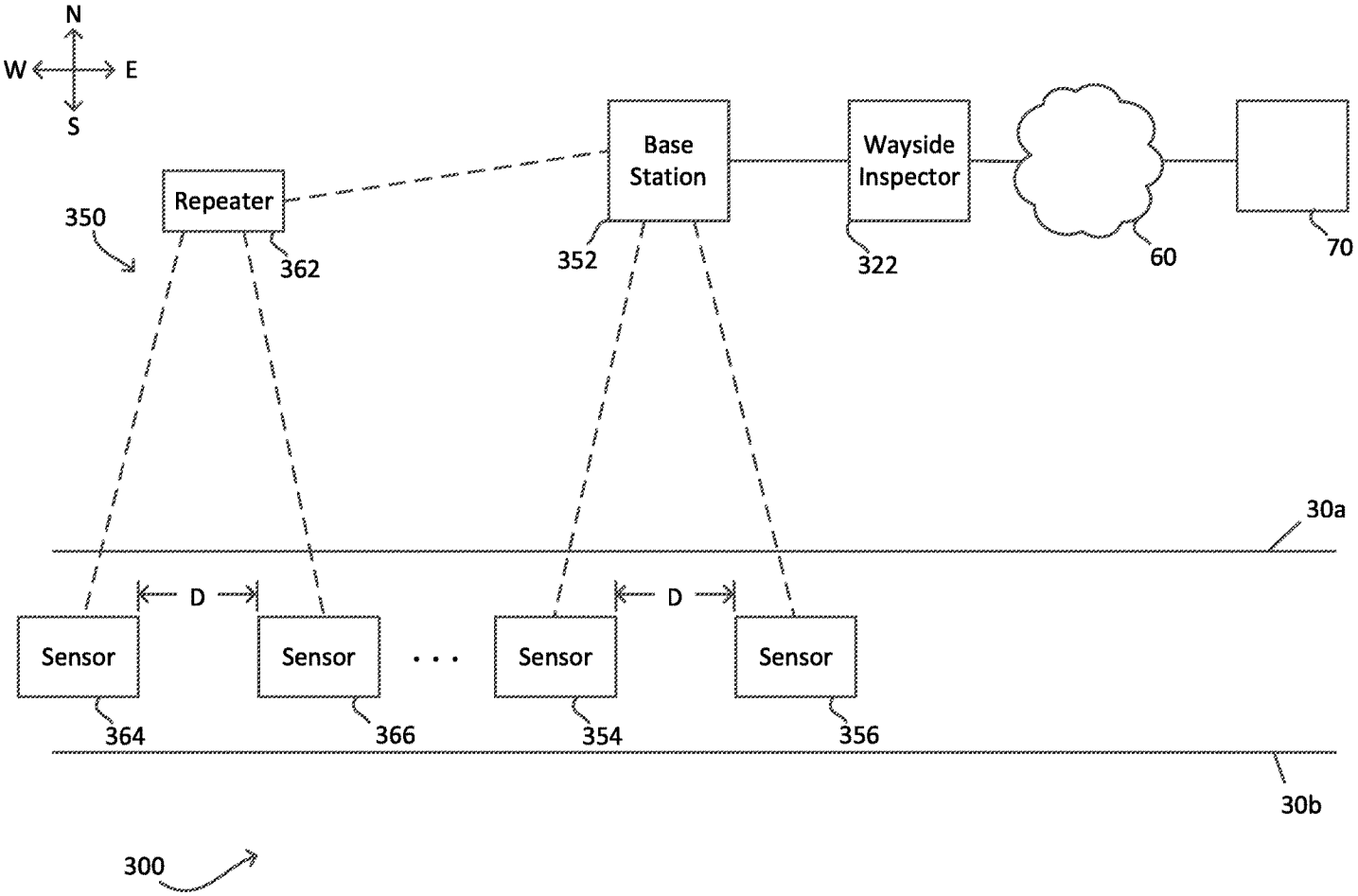
FIG. 3 illustrates a diagram of another example train direction and route detection system in accordance with another embodiment disclosed herein.

FIG. 3 illustrates a diagram of another example train direction and route detection system 300 constructed in accordance with another embodiment disclosed herein. The system 300 includes a wayside inspection system 350 having a wayside inspector 322 and base station 352 that are associated with more than two wireless presence detection sensors 354, 356, 364, 366 installed between the rails 30*a*, 30*b* of the railroad track 30. In a desired embodiment, the presence detection sensors 354, 356, 364, 366 are the same type of sensors used in the system 50 illustrated in FIG. 1. In the illustrated embodiment, the system 350 includes four train presence detection sensors 354, 356, 364, 366. It should be appreciated, however, that the system 350 is not limited to four sensors and that the system 350 would contain as many sensors as needed to detect all possible train directions and routes along the track 30.

In the illustrated embodiment, the leftmost presence detection sensors 364, 366 are too far from the base station 352 for their respective signals to reach the base station 352. As such, the system 350 includes a repeater 362 configured to wirelessly communicate with sensors 364, 366 and the base station 352. If Wimag sensors and a Wimag base station are used in the system 350, then a Wimag repeater, also manufactured by Siemens, should also be used.

During operation, signals from the leftmost train presence detection sensors 364, 366 are wirelessly transmitted to the repeater 362, which then re-transmits the signals to the base station 352. The base station 352 wirelessly receives the train presence detection signals (and sensor identifiers) from presence detection sensors 354 and 356 and the repeater 362 (for sensors 364 and 366) and processes the information in the same manner set forth above for system 50 (FIG. 1). The base station 352 outputs the data it receives to the wayside inspector 322, which executes method 200 in accordance with the principles set forth above.

Figure 4:
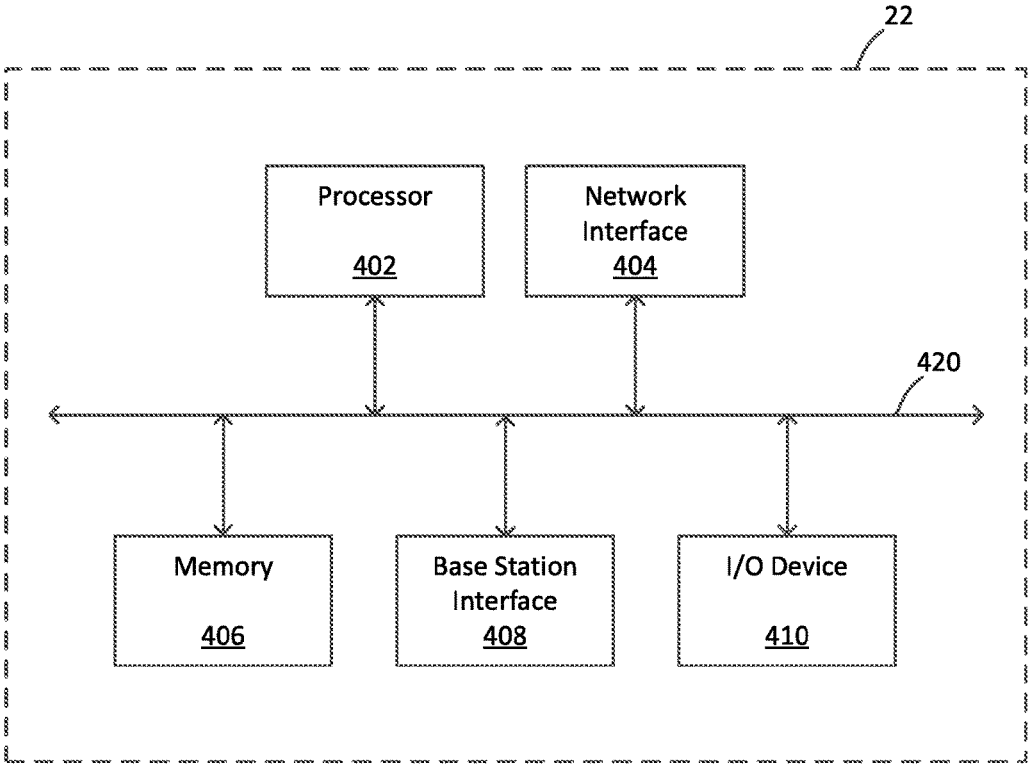
FIG. 4 illustrates a block diagram of a wayside inspector constructed in accordance with an embodiment disclosed herein.

FIG. 4 illustrates a block diagram of an example wayside inspector 22 constructed in accordance with an embodiment disclosed herein. The wayside inspector 22 includes a processor 402, network interface component 404, memory 406, base station interface component 408 and one or more input/output (I/O) devices 410 (e.g., keyboard, mouse) connected to one or more buses 420. The memory 406 can include volatile and non-volatile memory and can be used to store computer instructions executed by the processor 402 to implement method 200 and other required functions. The memory 406 can be used to store the database, look-up table, data structure, etc. used in method 200 to determine train direction and route. The memory 406 can also temporarily or permanently store train presence, direction and route data input/determined during the method 200.

The I/O devices 410 can be used by railroad personnel to, among other things, query and retrieve the information stored in the memory 406. This way, the railroad personnel can determine how the system is operating and make any necessary changes in the field. The network interface component 404 is used to interface the processor 402 to the network 60 by any suitable communication mechanism. The base station interface component 408 is used to interface the processor 402 to the base station (52, 352) by any suitable communication mechanism (e.g., an Ethernet connection if the Wimag base station is used).

The disclosed embodiments provide several advantages over existing railroad systems. The systems 10, 300 and method 200 provide a one of a kind, low cost retrofit option for over 200,000 crossing warning systems existing in the U.S. alone. It is expected that the disclosed systems 10, 300 and method 200 will save a railroad millions of dollars per year in labor and equipment costs that would normally be spent in an effort to manually satisfy FRA regulations. For example, the disclosed systems 10, 300 and method 200 can make train presence, direction and route determinations automatically using trains operating in accordance with their normal operating schedules. That is, the railroad does not need to run additional trains just to test the system, saving the railroad the labor and costs associated with running test trains.

Moreover, the sensors of the disclosed systems 10, 300 will be self-powered and communicate train presence detections wirelessly. This means that the sensors can be installed without cabling or wires for power or communications, which will also minimize labor and costs associated with installation and maintenance of the equipment by up to %75 for the typical system. Most importantly, federally mandated automated maintenance and other regulations can be implemented and satisfied since train directions and associated warning times for all routes can be detected and reported quite easily and automatically.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A method of determining a direction and route of travel of a train traveling on a railroad track, said method comprising:

detecting a presence of the train at a first presence detector located at a first portion of the track;

detecting a presence of the train at a second presence detector located at a second portion of the track;

determining the direction and route of travel of the train based on an order of the detections by the first and second presence detectors; and automatically reporting a determined direction and route of travel of the train to a regulation administration including a crossing warning time associated with the determined direction and route of travel of the train.

2. The method of claim 1, wherein the direction and route of travel corresponds to a first direction and a first route when it is determined that the first presence detector detected the presence of the train before the second presence detector detected the presence of the train.

3. The method of claim 2, wherein the direction and route of travel corresponds to a second direction and a second route when it is determined that the second presence detector detected the presence of the train before the first presence detector detected the presence of the train.

4. The method of claim 1, wherein the step of detecting the presence of the train at the first presence detector comprises inputting a first train detection signal from the first presence detector.

5. The method of claim 4, wherein the step of detecting the presence of the train at the second presence detector comprises inputting a second train detection signal from the second presence detector.

6. The method of claim 5, wherein the first train detection signal comprises a first time stamp, the second train detection signal comprises a second time stamp, and said determining step comprises determining the order of the detections using the first and second time stamps.

7. A railroad system comprising:

a first presence detector located at a first portion of a railroad track and being configured to detect a presence of a train at the first portion of the track;

a second presence detector located at a second portion of the track and being configured to detect a presence of the train at the second portion of the track;

a base station in wireless communications with the first and second presence detectors, said base station configured to receive a first train detection signal from the first presence detector and a second train detection signal from the second presence detector;

a wayside inspector in communication with the base station, said wayside inspector being configured to receive the first and second train detection signals from the base station and to determine a direction and route of travel of a train traveling on the track based on an order of the detections by the first and second presence detectors; and a back office system in communication with the wayside inspector via a network, said wayside inspector transmitting a determined direction and route of travel to the back office system, wherein the back office system automatically reports the determined direction and route of travel to a regulation administration including a crossing warning time associated with the determined direction and route of travel of the train.

8. The system of claim 7, wherein the direction and route of travel corresponds to a first direction and a first route when the wayside inspector determines that the first presence detector detected the presence of the train before the second presence detector detected the presence of the train.

9. The system of claim 8, wherein the direction and route of travel corresponds to a second direction and a second route when the wayside inspector determines that the second presence detector detected the presence of the train before the first presence detector detected the presence of the train.

10. The system of claim 7, wherein the base station transmits to the wayside inspector a first time stamp along with the first train detection signal and a second time stamp along with the second train detection signal.

11. The system of claim 8, wherein the wayside inspector determines the order of the detections using the first and second time stamps.

12. The system of claim 7, wherein the first and second presence detectors comprise wireless magnetometer sensors.

13. The system of claim 7, further comprising:

a third presence detector located at a third portion of the track and being configured to detect a presence of the train at the third portion of the track;

a fourth presence detector located at a fourth portion of the track and being configured to detect a presence of the train at the fourth portion of the track; and a repeater in wireless communications with the third and fourth presence detectors and the base station, said repeater being configured to receive a third train detection signal from the third presence detector and a fourth train detection signal from the fourth presence detector and to transmit the third and fourth train detection signals to the base station.

14. The system of claim 13, wherein the first, second, third and fourth presence detectors comprise wireless magnetometer sensors.

* * * * *